US009121573B2

(12) United States Patent
Johns et al.

(10) Patent No.: US 9,121,573 B2
(45) Date of Patent: Sep. 1, 2015

(54) OPTICAL ASSEMBLY FOR A LIGHTING FIXTURE

(75) Inventors: Steven William Johns, Vancouver (CA); Zoltan Mezo, Surrey (CA)

(73) Assignee: Koninklijke Philips N.V., Eindhoven (NL)

( * ) Notice: Subject to any disclaimer, the term of this patent is extended or adjusted under 35 U.S.C. 154(b) by 20 days.

(21) Appl. No.: 13/980,711

(22) PCT Filed: Jan. 18, 2012

(86) PCT No.: PCT/IB2012/050244

§ 371 (c)(1),
(2), (4) Date: Dec. 26, 2013

(87) PCT Pub. No.: WO2012/098507

PCT Pub. Date: Jul. 26, 2012

(65) Prior Publication Data

US 2014/0104827 A1 Apr. 17, 2014

Related U.S. Application Data

(60) Provisional application No. 61/434,529, filed on Jan. 20, 2011.

(51) Int. Cl.

| | |
|---|---|
| ***F21V 5/04*** | (2006.01) |
| ***F21S 8/06*** | (2006.01) |
| ***F21V 3/02*** | (2006.01) |
| ***F21V 3/04*** | (2006.01) |
| ***F21V 5/00*** | (2015.01) |
| ***F21V 13/02*** | (2006.01) |
| ***F21V 15/015*** | (2006.01) |
| ***F21V 17/16*** | (2006.01) |
| *F21S 2/00* | (2006.01) |
| *F21V 21/005* | (2006.01) |
| *F21Y 103/00* | (2006.01) |

(52) U.S. Cl.

CPC . *F21V 5/04* (2013.01); *F21S 8/063* (2013.01); *F21V 3/02* (2013.01); *F21V 3/04* (2013.01); *F21V 3/0445* (2013.01); *F21V 5/002* (2013.01); *F21V 5/008* (2013.01); *F21V 13/02* (2013.01); *F21V 15/015* (2013.01); *F21V 17/162* (2013.01); *F21S 2/005* (2013.01); *F21V 21/005* (2013.01); *F21Y 2103/00* (2013.01)

(58) Field of Classification Search

USPC ..... 362/222, 223, 330, 217.02, 217.1, 362/217.11, 217.15, 311.02, 262, 433

See application file for complete search history.

(56) References Cited

U.S. PATENT DOCUMENTS

| | | | |
|---|---|---|---|
| 2,873,358 | A | 2/1959 | Josef Dunker |
| 4,061,422 | A | 12/1977 | Geurts et al. |
| 4,891,737 | A | 1/1990 | Szymanek |

(Continued)

FOREIGN PATENT DOCUMENTS

| | | | |
|---|---|---|---|
| CN | 101629680 | A | 1/2010 |
| EP | 1258675 | A2 | 11/2002 |

*Primary Examiner* — Laura Tso

(74) *Attorney, Agent, or Firm* — Meenakshy Chakravorty

(57) ABSTRACT

Inventive methods and apparatus for an optical assembly for a lighting fixture are disclosed. The optical assembly includes a lens (20A, 20B) having an interior face and an optical film (40A, 40B) provided atop the interior face of the lens. A deformable structure may be positioned adjacent the optical film (40A, 40B) and exert force on the optical film (40A, 40B), thereby compressing the optical film (40A, 40B) against the lens (20A, 20B).

20 Claims, 10 Drawing Sheets

(56) References Cited

U.S. PATENT DOCUMENTS 5,716,123 A 2/1998 Lamming
7,824,050 B2 * 11/2010 Tsai et al. ..... 362/97.4
2011/0149548 A1 * 6/2011 Yang et al. ..... 362/84

* cited by examiner

OPTICAL ASSEMBLY FOR A LIGHTING FIXTURE

TECHNICAL FIELD

The present invention is directed generally to an optical assembly. More particularly, various inventive methods and apparatus disclosed herein relate to an optical assembly for a lighting fixture.

BACKGROUND

The utilization of optical films in lighting fixtures is generally known. Optical films may be utilized to inter alia, minimize hot spots from light sources, constrain and/or disperse lighting for control and/or uniformity, and/or create controlled patterns of light by redirecting light into a desired light distribution. Such optical films include those that utilize mesoOptics® technology available from Ledalite of Philips Lighting. Such optical films may be applied over a lens of a lighting fixture. Known methodologies of applying the optical films include the use of adhesives and other types of binding (e.g. heat binding). While such methodologies may be satisfactory in some implementations, in many implementations such methodologies may suffer from one or more drawbacks.

For example, in some implementations known methodologies may be costly, may not enable flexible movement of the optical film atop the lens, and/or may not enable the optical film to be appropriately positioned relative to the lens.

Thus, there is a need in the art to provide an optical assembly that includes a deformable structure that exerts force on an optical film that is placed atop a lens, to thereby compress the optical film against the lens and overcome one or more of the aforementioned or other problems with the known methodologies.

SUMMARY

The present disclosure is directed to inventive methods and apparatus for an optical assembly for a lighting fixture. For example, the optical assembly may include a lens having an interior and an exterior face. An optical film may be provided atop the interior face of the lens. A deformable structure may be positioned adjacent the optical film and exert force on the optical film, thereby compressing the optical film against the lens. Optionally, the deformable structure is deformed within a lip structure spaced apart from and extending above a portion of the interior face of the lens. Optionally, the interface between the optical film and the lens may be substantially adhesive free.

Generally, in one aspect, a lighting fixture is provided that includes a housing and a longitudinally extending lens. The lens has a lens first latitudinal end, a lens second latitudinal end opposite the lens first latitudinal end, an interior face, and an exterior face opposite the interior face. The lighting fixture also includes a longitudinally extending first support structure supported by the housing. The first support structure extends at least partially between the first latitudinal end and the second latitudinal end and supports the lens. The first support structure includes an upper lip structure on a first side of the lens extending above a portion of the lens. The interior face of the lens generally faces the first side. The lighting fixture also includes an optical film atop the interior face of the lens. The optical film has an optical film first latitudinal end near the lens first latitudinal end and an optical film second latitudinal end near the lens second latitudinal end.

The optical film extends between at least a portion of the upper lip structure and the lens. The lighting fixture also includes a deformable structure compressed between the upper lip structure and the optical film. The deformable structure exerts force on the optical film, thereby compressing the optical film against the lens.

In some embodiments the lighting fixture further includes a longitudinally extending second support structure supported by the housing, wherein the second support structure and the first support structure flank the lens. In some versions of those embodiments the second support structure includes a second upper lip structure on the first side of the lens extending above a portion of the lens. Optionally, the optical film extends between at least a portion of the second upper lip structure and the lens, and the optical film is compression free where it extends between the second upper lip structure and the lens.

In some embodiments the optical film first latitudinal end extends beyond the lens first latitudinal end. In some versions of those embodiments the lens first latitudinal end extends beyond the first support structure.

In some embodiments the deformable structure is tubular.

In some embodiments the deformable structure is less than fifteen percent of a length of the lens, the length of the lens being between the extent of the first latitudinal end and the extent of the second latitudinal end. In some versions of those embodiments the deformable structure is less than five percent of the length.

In some embodiments the lens and the first support structure are formed as a cohesive integral piece.

Generally, in another aspect a lighting fixture is provided that includes a housing having at least one light exit opening. A lens is supported by the housing across a majority of the light exit opening when installed in the housing. The lens has an interior face generally facing interiorly of the housing and an exterior face generally facing away from the housing when installed in the housing. A lip structure is spaced apart from and extends above a portion of the interior face of the lens proximal a peripheral portion of the lens. An optical film is provided atop the interior face of the lens. The interface between the optical film and the lens is substantially adhesive free. A deformable structure is compressed between the upper lip structure and the optical film and exerts force on the optical film, thereby compressing the optical film against the lens. The length of the deformable structure is substantially shorter than the length of the lens.

In some embodiments the lens and the lip structure are formed as a cohesive integral piece.

In some embodiments the deformable structure is tubular.

In some embodiments the deformable structure is elastomeric.

In some embodiments the interface between the optical film and the lens is completely adhesive free.

In some embodiments the length of the deformable structure is less than ten percent of the length of the lens.

In some embodiments the light exit opening includes an unbounded portion.

Generally, in another aspect an optical assembly is provided that includes a lens having a generally planar first side, a second side generally opposite the first side, and a periphery therearound. The optically assembly also includes a lip structure coupled to the lens that is spaced apart from and extends above the first side of the lens. The optically assembly also includes an optical film atop the first side of the lens. The interface between the optical film and the lens is adhesive free. The optically assembly also includes a deformable structure compressed between the upper lip structure and the optical film. The deformable structure exerts force on the optical film, thereby compressing the optical film against the lens. The length of the deformable structure is less than fifteen percent of the length of the lens.

In some embodiments the length of the deformable structure is less than five percent of the length of the lens.

In some embodiments the lip structure is provided on a first longitudinal side of the lens and extends less than the length of the first longitudinal side of the lens.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
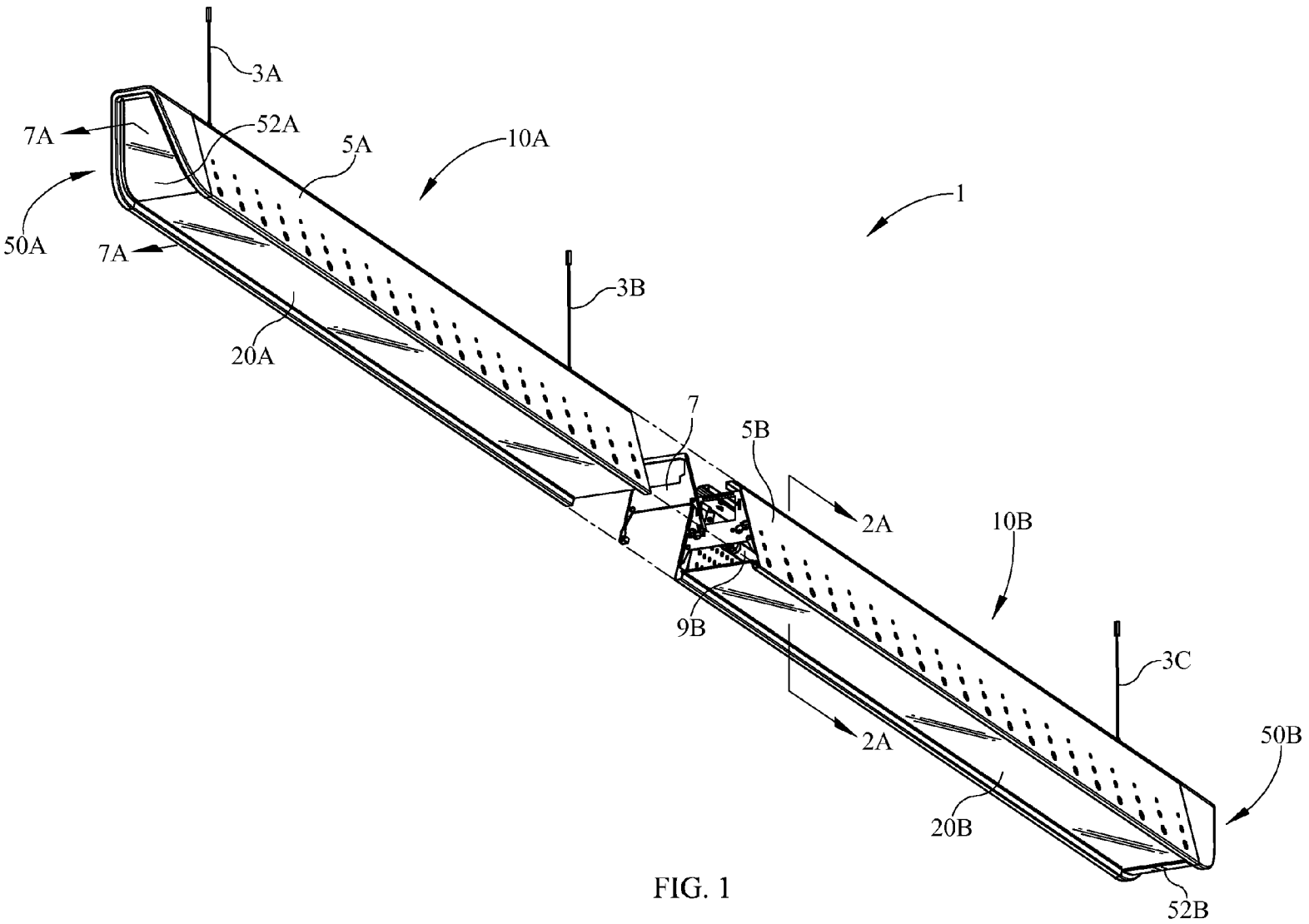
FIG. 1 illustrates an embodiment of a modular lighting system having a first lighting fixture and a second lighting fixture; the first lighting fixture and the second lighting fixture are depicted exploded away from one another.

Known methodologies of applying optical films over a lens of a lighting fixture include the use of adhesives and other types of binding (e.g. heat binding). While such methodologies may be satisfactory in some implementations, in other implementations such methodologies may suffer from one or more drawbacks. For example, in some implementations known methodologies may be costly, may not enable flexible movement of the optical film atop the lens, and/or may not enable the optical film to be appropriately positioned relative to the lens.

Thus, the Applicants have recognized a need to provide an optical assembly that includes a deformable structure that exerts force on an optical film that is placed atop a lens, to thereby compress the optical film against the lens and overcome one or more of the aforementioned or other problems with the known methodologies. Optionally, the optical assembly includes a lens having an interior and an exterior face and an optical film may be provided atop the interior face of the lens. A deformable structure may be positioned adjacent the optical film and exert force on the optical film, thereby compressing the optical film against the lens. Optionally, the deformable structure is deformed within a lip structure spaced apart from and extending above a portion of the interior face of the lens. Optionally, the interface between the optical film and the lens may be substantially adhesive free.

More generally, Applicants have recognized and appreciated that it would be beneficial to provide an optical assembly for a lighting fixture that includes a deformable structure for retaining an optical film of the optical assembly.

In view of the foregoing, various embodiments and implementations of the present invention are directed to an optical assembly for a lighting fixture. More particularly, various inventive methods and apparatus disclosed herein relate to a lighting fixture having a lens with an optical film atop an interior face of the lens, wherein a portion of the optical film is compressed against the lens by a deformable structure.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. For example, throughout the Figures a fluorescent bulb is depicted installed within the lighting fixtures. However, one of ordinary skill in the art, having had the benefit of the present disclosure will recognize and appreciate that in other implementations other light sources may additionally or alternatively be utilized in a lighting fixture. For example, an LED light source may be utilized instead of the fluorescent light source and may optionally be integrated with one or more of a heatsink, a LED driver, and/or optical lens provided over one or more of the LEDs of the LED light source. Also, although throughout the Figures lighting fixtures that may be coupled to other lighting fixtures in an end to end manner are depicted, one of ordinary skill in the art, having had the benefit of the present disclosure will recognize and appreciate that in other implementations other lighting fixtures may additionally or alternatively be utilized in combination with the lens, optical film, and deformable structure described herein. Moreover, descriptions of well-known apparatuses and methods may be omitted so as to not obscure the description of the representative embodiments. Such methods and apparatuses are clearly within the scope of the claimed invention.

Referring to FIG. 1, in one embodiment, a modular lighting system 1 includes a first lighting fixture 10A and a second lighting fixture 10B. The first lighting fixture 10A and the second lighting fixture 10B are coupleable to one another in an end to end manner and are depicted exploded away from one another in FIG. 1. In the depicted embodiment the first and second lighting fixtures 10A, 10B have a substantially similar configuration and like numbering between the two generally refers to like parts. Moreover, when detailed description is given of one of the lighting fixtures 10A, 10B, it is understood that the other of the lighting fixtures 10A, 10B may be similarly described. Although the depicted first and second lighting fixtures 10A, 10B have a substantially similar configuration, in alternative embodiments one or more lighting fixtures in a modular lighting system may have a unique configuration. The lighting fixtures 10A, 10B include respective longitudinally extending housings 5A, 5B that generally support other components of the lighting fixtures 10A, 10B. The housings 5A, 5B may in some embodiments be formed of sheet metal and/or extruded aluminum. A gasket 7 is depicted interposed between the first lighting fixture 10A and the second lighting fixture 10B and will be interposed between the two lighting fixtures 10A, 10B when they are coupled to one another. The gasket 7 may help prevent light leaks at the junction point of the housing 5A, 5B and/or may promote a good seal between the two lighting fixtures 10A, 10B.

Two hanger wires 3A and 3B are depicted coupled to the housing 5A and extending upwardly therefrom and a single piece of hanger wire 3C is depicted coupled to the housing 5B and extending upwardly therefrom. The hanger wires 3A, 3B, and 3C may be coupled to a beam or other support to suspend the lighting fixtures 10A and 10B in a desired installation location. Although hanger wires 3A, 3B, and 3C are depicted in the Figures, one of ordinary skill in the art, having had the benefit of the present disclosure, will recognize and appreciate that other installation apparatus and methodologies may be utilized in conjunction with the claimed lighting fixture. For example, in some embodiments the lighting fixtures 10A, 10B may be installed in a recessed fashion.

The lighting fixtures 10A, 10B also include respective lenses 20A, 20B. Lens 20A is provided over a longitudinally extending light exit opening of the first lighting fixture 10A that is open at two latitudinal ends thereof. At a first latitudinal end, the light exit opening of the first lighting fixture 10A interfaces with an open end of a light exit opening of the second lighting fixture 10B. At a second latitudinal end, the light exit opening interfaces with an end cap 50A that includes an outer upwardly curved lens 52A. Lens 20B is provided over a longitudinally extending light exit opening of the second lighting fixture 10B that is open at two latitudinal ends thereof. At a first latitudinal end, the light exit opening of the second lighting fixture 10B interfaces with an open end of the light exit opening of the first lighting fixture 10A. At a second latitudinal end, the light exit opening interfaces with an end cap 50B that includes an outer upwardly curved lens 52A.

The lenses 20A and 20B are slightly recessed within their respective housing 5A and 5B. However, one of ordinary skill in the art, having had the benefit of the present disclosure will recognize and appreciate that in other embodiments other lens configurations may be provided. For example, in some embodiments the lens may be flush with respect to the surrounding housing, the lighting fixtures may be recessed into the ceiling and the lens may be flush with the ceiling, or the lighting fixtures may be recessed into the ceiling and the lens may be recessed with respect to the ceiling. Also, although the lighting fixtures 10A and 10B are depicted with respective end caps 50A and 50B, one of ordinary skill in the art, having had the benefit of the present disclosure will recognize and appreciate that in other embodiments the end caps may be omitted and/or alternative end caps may be provided. For example, in some embodiments the end cap 50A may be omitted from the first lighting fixture 10A and the lighting fixture 10A may be used as an intermediary lighting fixture. Also, for example, in some embodiments the end caps 50A and 50B may be omitted and the lighting fixtures 10A and 10B may be configured for recessed installation. Also, for example, in some embodiments a flat endcap may be provided at the latitudinal ends of the housings 5A and/or 5B. Optionally, the flat end cap may extend substantially perpendicular to the light exit opening of the housings 5A and/or 5B.

A fluorescent light source 9B is visible within the housing 5B and extends from near the first latitudinal end of the light exit opening of the second lighting fixture 10B to near the second latitudinal end of the second lighting fixture 10B. Light output from the fluorescent light source 9B is directed generally toward the light exit opening and through the lens 20B. The fluorescent light source 9B is coupled to a fluorescent socket and an appropriate electrical ballast.

Figure 2A:
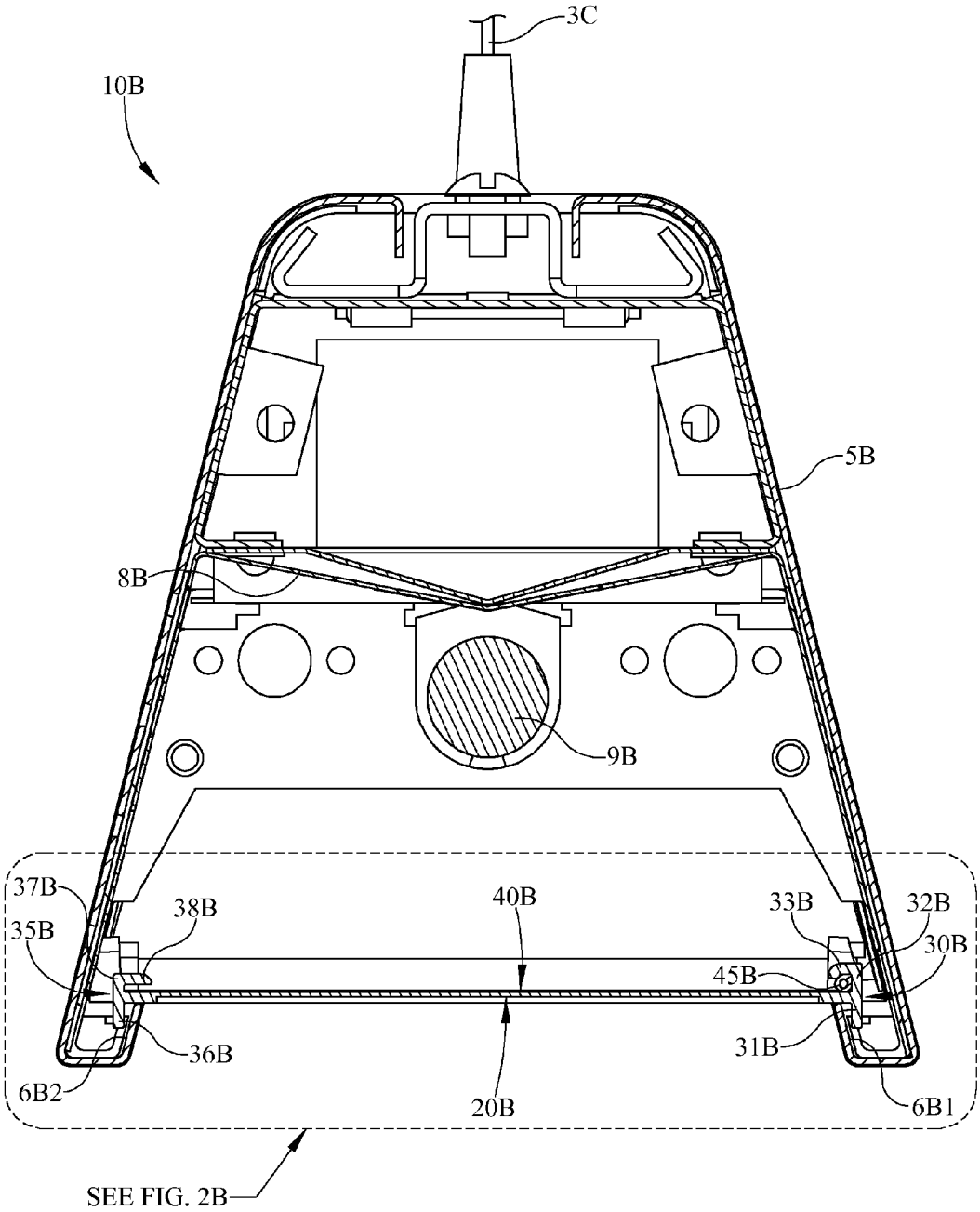
FIG. 2A illustrates a section view of the second lighting fixture of the embodiment of FIG. 1 taken along the section line 2A-2A of FIG. 1.
Figure 2B:
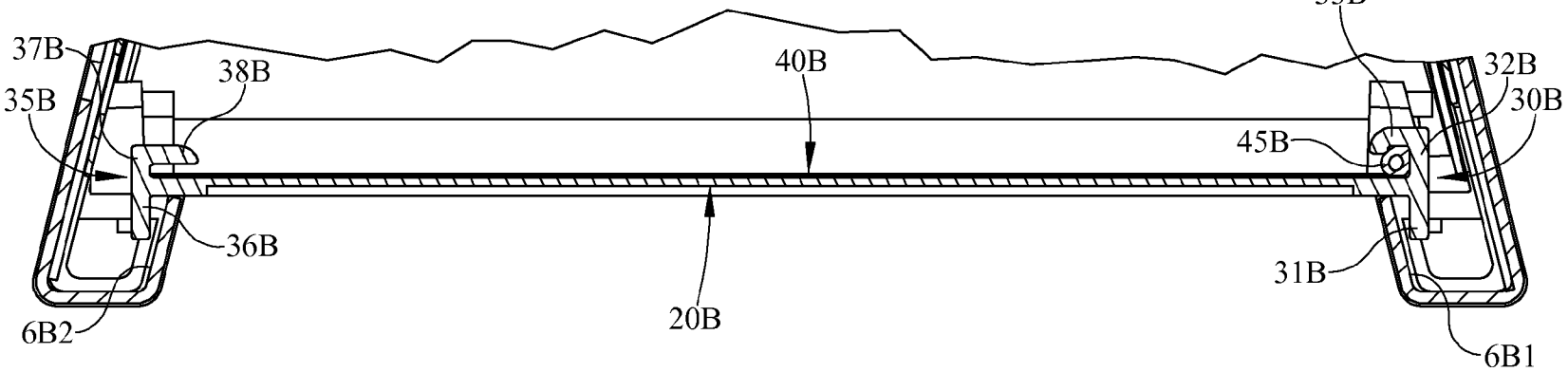
FIG. 2B shows a close up section view of a portion of the second lighting fixture generally indicated in FIG. 2A.

Referring to FIGS. 2A and 2B, a section view of the second lighting fixture 10B taken along the section line 2A-2A of FIG. 1 is shown. FIG. 2B shows a close up of a portion of the section view that is generally indicated in FIG. 2A. The generally trapezoidal cross section of the housing 5B is depicted in FIG. 2A. Also visible in FIG. 2A is a reflector 8B that is supported by the housing 5B and is provided above and to the sides of the light source 9B. The reflector 8B is positioned to direct light toward and through the lens 20B and may optionally have a highly reflective mirror finish. In alternative embodiments alternative reflector configurations may be utilized. For example, in some embodiments where an LED light source is used, the reflector may have a different shape and/or may be a diffuse surface. Above the reflector 8B is a space that may optionally be utilized for cooling, housing an electronic ballast, and/or aesthetics. Longitudinally extending troughs 6B1 and 6B2 are provided on each side of the base of the housing 5B. The troughs 6B1 and 6B2 generally define the longitudinal edges of the light exit opening and support the lens 20B across the light exit opening.

Flanking the lens 20B is a first support structure 30B and a second support structure 35B. The support structures 30B, 35B are formed with the lens 20B as a cohesive integral piece in the depicted embodiment. Optionally, the lens 20B and the support structure 30B, 35B may comprise acrylic. In alternative embodiments the support structure(s) 30B and/or 35B may be separate from and coupled to the lens 20B.

The support structure 35B is supported by the housing 5B and includes a lower leg 36B that extends downward from and generally perpendicular to the lens 20B into the trough 6B2. The support structure 35B also includes an upper leg 37B that extends upward from and generally perpendicular to the lens 20B. Extending inward from the upper leg 37B is an upper lip structure 38B. The upper lip structure 38B is generally flat on its interior face and generally runs parallel to the lens 20B on its interior face. The upper lip structure 38B and the lens 20B generally define a recess therebetween. An optical film 40B is placed atop the lens 20B and extends into the recess between the upper lip structure 38B and the lens 20B. In some embodiments the optical film 40B may be an optical film utilizing MesoOptics® technology available from Ledalite of Philips Lighting. The upper lip structure 38B may help to maintain the optical film 40B within a predefined area (e.g., restraining vertical up/down movement) during movement of the lens 20B, but does not compress against the optical film 40B in the depicted embodiment.

The support structure 30B is supported by the housing 5B and includes a lower leg 31B that extends downward from and generally perpendicular to the lens 20B into the trough 6B1. The lower legs 31B and 36B cooperatively function to substantially maintain the longitudinal side to longitudinal side positioning of the lens 20B over the light exit opening. Latitudinal end to latitudinal end positioning may be maintained by the gasket 7, the end cap 50B, and/or interaction with an adjacent optical structure. The support structure 30B also includes an upper leg 32B that extends upward from and generally perpendicular to the lens 20B. Extending inward from the upper leg 32B is an upper lip structure 33B. The upper lip structure 33B is generally curved on its interior face and includes a flange at an end thereof distal the upper leg 32B. The optical film 40B extends into a recess generally defined by the upper lip structure 33B and the upper leg 32B. Also received within the recess is a deformable tube 45B. In its non-deformed state, the deformable tube 45B is larger than the recess, thereby requiring the deformable tube to be in a deformed, compressed state within the recess. Accordingly, the deformable tube 45B exerts outward pressure on the optical film 40B, thereby pressing the optical film 40B against the lens 20B. The flange at the end of the upper lip structure 33B may help maintain the deformable tube 45B within the recess and/or help maintain the deformable tube 45B in a deformed state. In some embodiments the deformable tube may be a polymeric material such as, for example, polyvinyl chloride (PVC) or polyethylene (PE). Although a deformable tube 45B is depicted, in alternative embodiments a non-tubular deformable structure may be utilized. For example, in alternative embodiments a deformable polymeric rod may be utilized.

Figure 3:
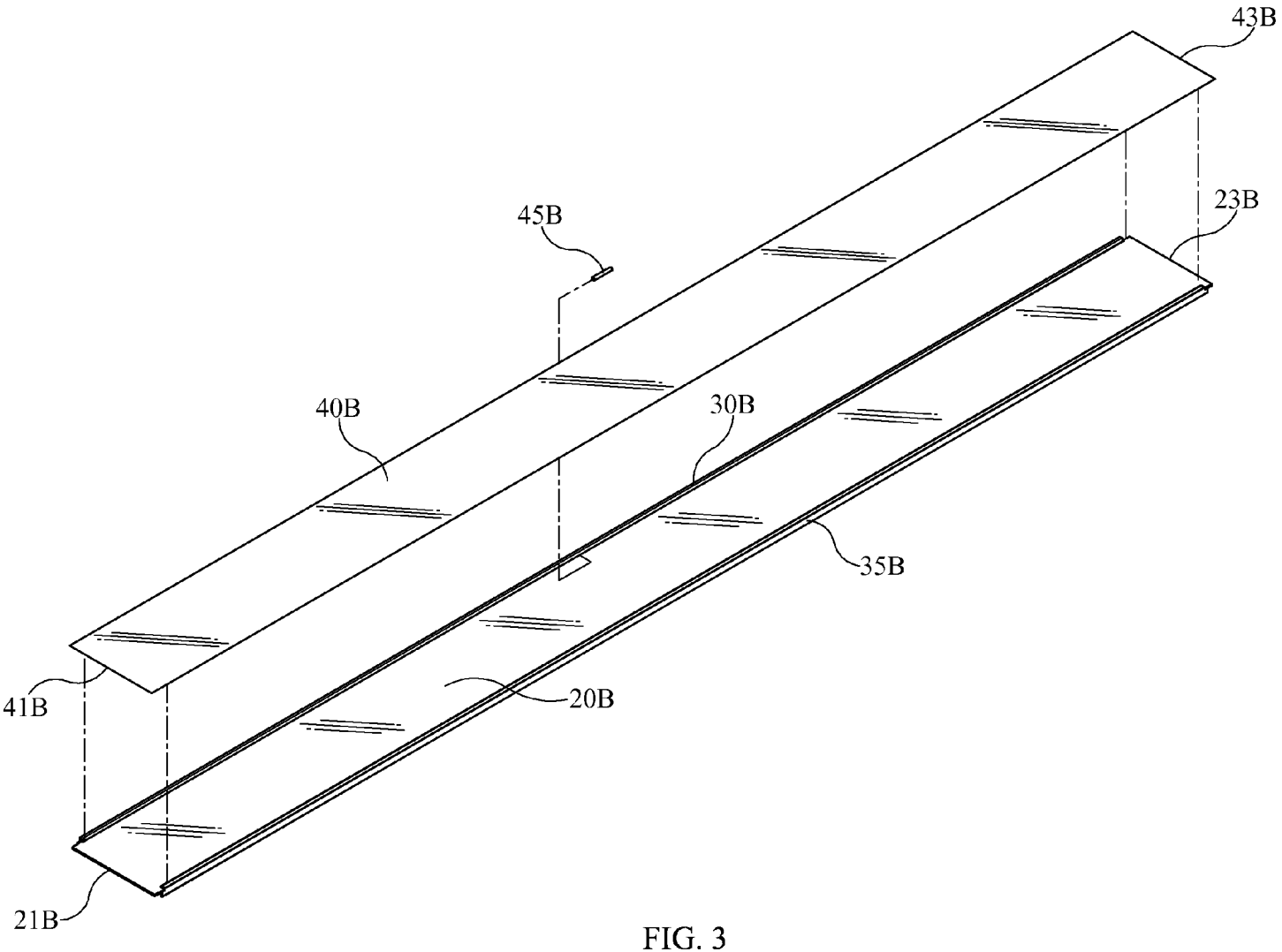
FIG. 3 shows a perspective view of an optical assembly of the second lighting fixture of the embodiment of FIG. 1; an optical film of the optical assembly and a deformable structure of the optical assembly are shown exploded away from a lens of the optical assembly.
Figure 4:
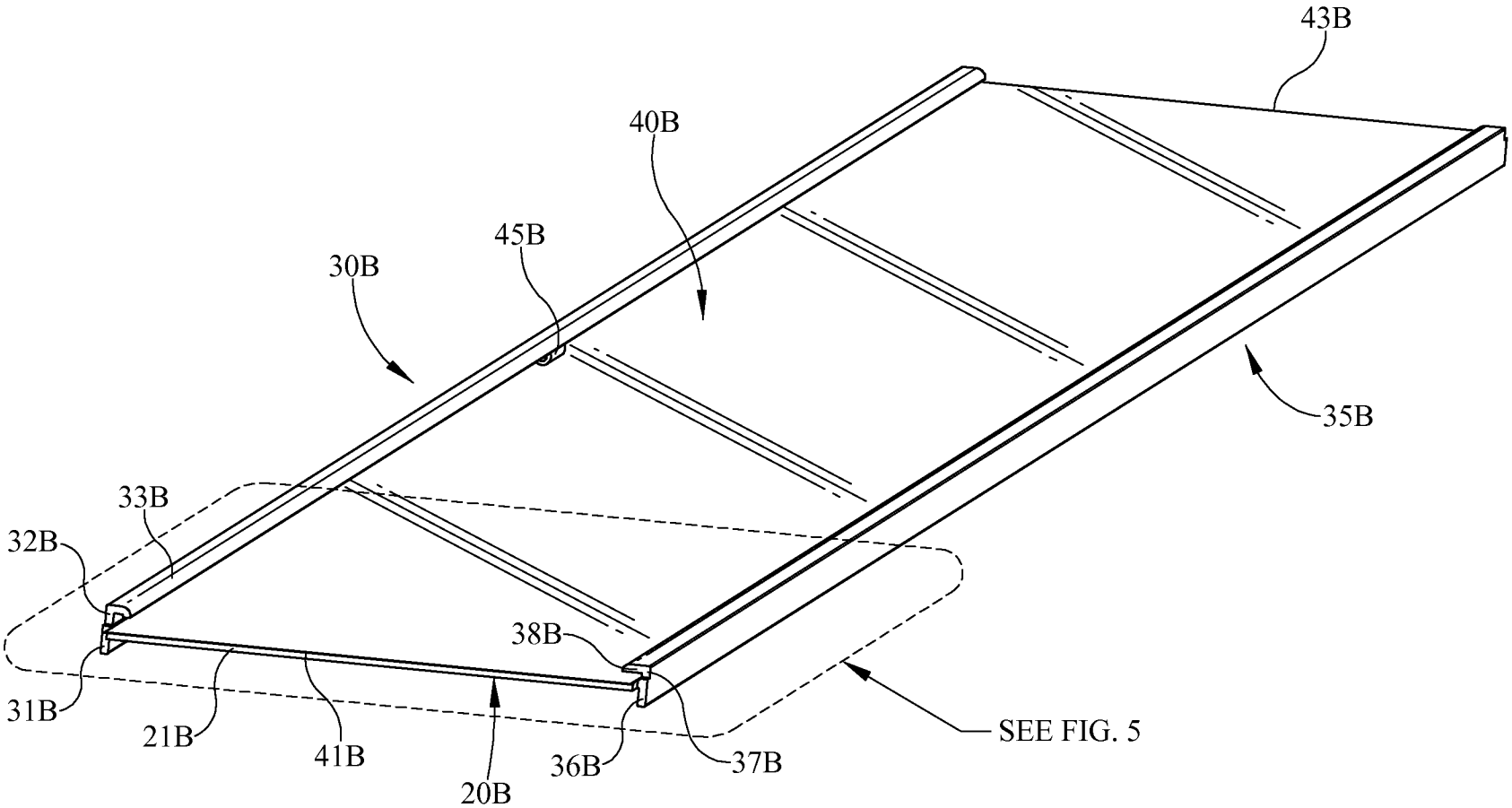
FIG. 4 shows an unexploded perspective view of the optical assembly of FIG. 3.
Figure 5:
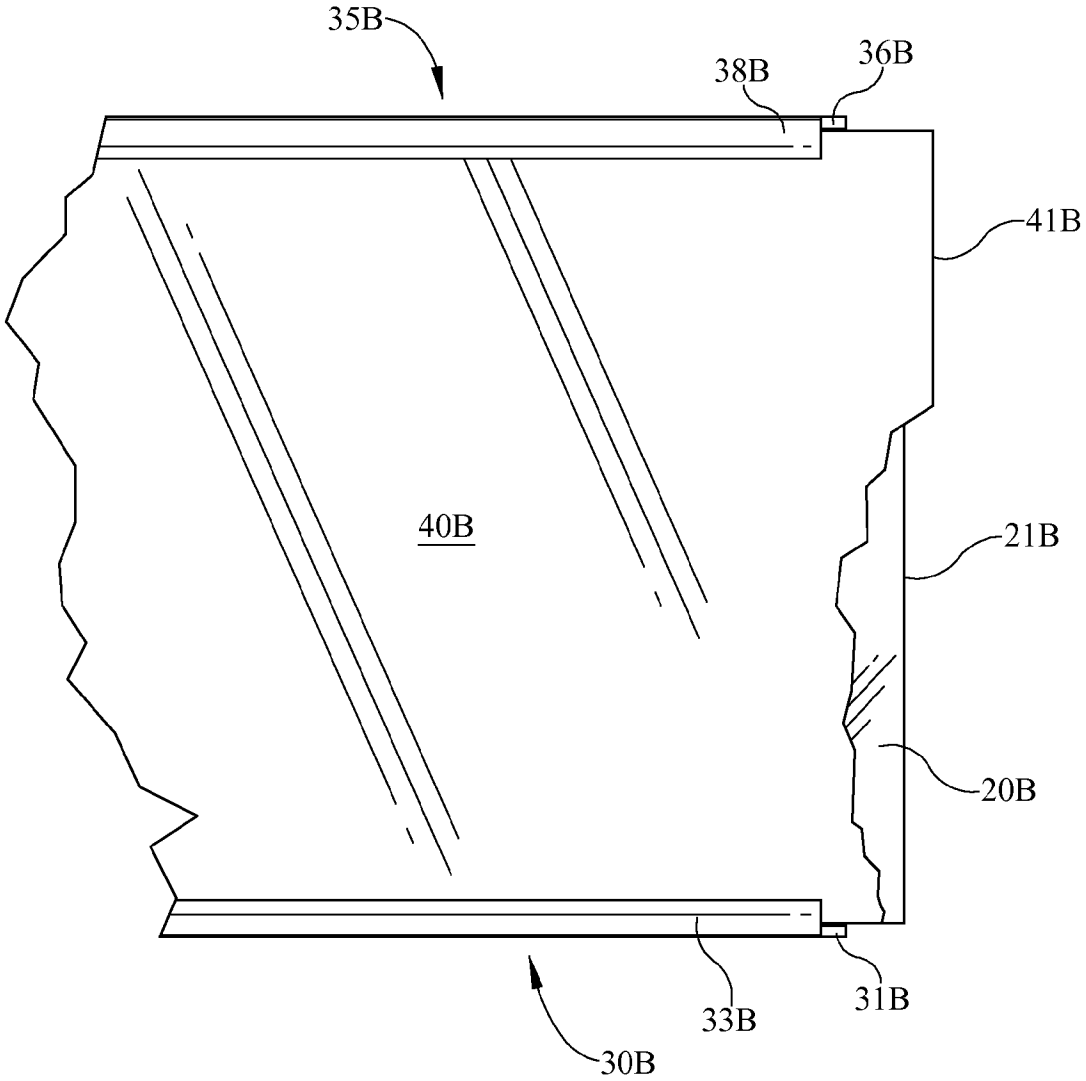
FIG. 5 shows a close up top view of a portion of the optical assembly of FIG. 4 generally indicated in FIG. 4; a portion of the optical film of the optical assembly is broken away to show a portion of the lens atop which the optical film lies.

Referring to FIG. 3 through FIG. 5, the optical assembly of the second lighting fixture 10B is shown in additional detail. In FIG. 3, the optical film 40B of the optical assembly and the deformable tube 45B of the optical assembly are shown exploded away from the lens 20B of the optical assembly. Referring to FIGS. 3 and 4, it is illustrated that the lens 20B includes a first latitudinal end 21B and a second latitudinal end 23B and that the optical film 40B also includes a first latitudinal end 41B and a second latitudinal end 43B. The deformable tube 45B is positioned within the recess generally defined by the upper lip structure 33B and the upper leg 32B approximately midway between then lens first latitudinal end 21B and lens second latitudinal end 23B. The length of the deformable tube 45B in the depicted embodiment is approximately two percent of the distance between the lens first latitudinal end 21B and lens second latitudinal end 23B. In various embodiments the interface between the lens 20B and the optical film 40B may be substantially adhesive free. In versions of those embodiments the deformable tube 45B may be the only structure actively compressing the optical film 40B against the lens 20B. The use of only the deformable tube 40B on one side of the interface between the lens 20B and optical film 40B, that is of a substantially smaller length than the lens 20B, may enable the optical film 40B to be maintained in a substantially fixed longitudinal relationship atop the lens 20B (relative to the first latitudinal end 21B and second latitudinal end 23B), while still enabling movement of the optical film 40B atop the lens 20B due to heating/cooling, installation/removal, etc. and minimizing any binding of the optical film 40B during such movement. The deformable tube 40B may also limit or prohibit movement of the optical film 40B side to side (relative to supports 30B, 35B) independently of, or in conjunction with, supports 30B, 35B. In some embodiments the distance between supports 30B, 35B may be greater than the width of the optical film 40B to enable the optical film to expand without binding.

In FIG. 4 and FIG. 5, it can be seen that the first latitudinal end 41B of the optical film 40B extends beyond the first latitudinal end 21B of the lens 20B. A portion of the optical film 40B is shown broken away in FIG. 5 to better illustrate the optical film 40B extending beyond the lens 20B. The second latitudinal end 43B of the optical film 40B similarly extends beyond the second latitudinal end 23B of the lens 20B. As described in additional detail herein, the extending of the optical film 40B beyond the lens 20B may, for example, help to minimize light leaks in between lens 20B and a lens of a lighting fixture coupled end to end with the second lighting fixture 10B. Also, in FIG. 4 and FIG. 5, it can be seen that the first latitudinal end 21B of the lens 20B extends longitudinally beyond the support structures 30B and 35B. The second latitudinal end 23B of the lens 20B similarly extends longitudinally beyond the support structures 30B and 35B. As described in additional detail herein, the extending of the lens 20B beyond the support structures 30B and 35B may enable flexibility of the lens 20B and/or optical film 40B proximal respective latitudinal ends 21B, 23B, 41B, and 43B. Such flexibility may be beneficial, for example, during installation/removal of the optical assembly and/or during shifting of the optical assembly due to heating/cooling, or otherwise. Also, in FIG. 4 and FIG. 5, it can be seen that the lower legs 31B, 36B of the supports 30B, 35B extend beyond the upper legs 32B, 37B and the upper lips 33B, 38B on both ends of the supports 30B, 35B. Such a configuration may enable, for example, the optical film 40B to flex upward during installation/removal of the optical assembly and/or installation/removal of an optical assembly of a lighting fixture coupled end to end with second lighting fixture 10B.

Figure 6A:
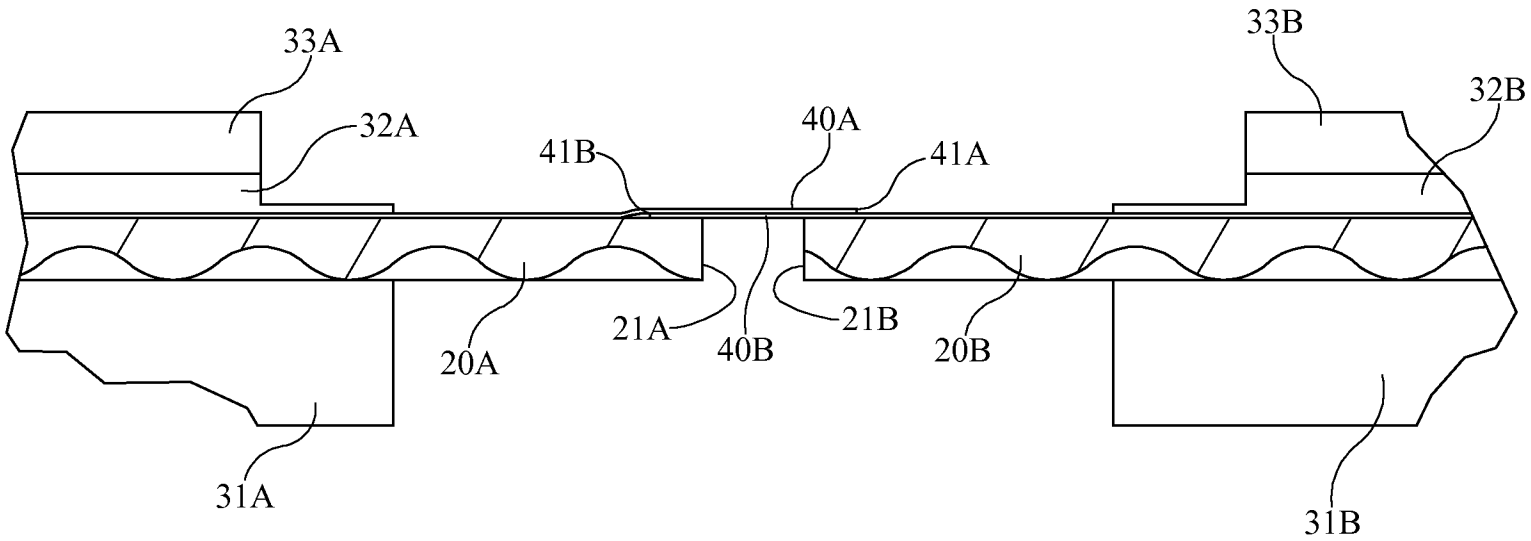
FIG. 6A shows a side section view of the optical assemblies of the first lighting fixture and the second lighting fixture of the embodiment of FIG. 1, when the lighting fixtures are coupled to one another in an end to end relationship.

Referring to FIG. 6A, a side section view of the optical assemblies of the first lighting fixture 10A and the second lighting fixture 10B are shown, when the lighting fixtures 10A and 10B are coupled to one another in an end to end relationship. Other structure of the lighting fixtures 10A, 10B is omitted from FIG. 6A for clarity. The latitudinal ends 21A, 21B of the lenses 20A, 20B are adjacent each other, but are not touching one another. The depicted lenses 20A and 20B are frosted acrylic lenses that have ridges, which are visible in the section views herein. In alternative embodiments alternative lens configurations may be utilized. The optical films 40A, 40B overlap one another and, in the depicted embodiment, the optical film latitudinal end 41B extends above lens 20A and the optical film latitudinal end 41A extends above lens 20B. In alternative embodiments and/or after heating/cooling or otherwise shifting, the optical films 40A, 40B may overlap one another or nearly overlap one another, but not extend above the neighboring lens 20A, 20B. It is understood that, depending on the installation and the particular configuration of the lighting fixtures, in some installations the lenses 20A, 20B may be closer together or farther apart than depicted in FIG. 6A. Also, the optical films 40A, 40B may overlap to a greater degree, a lesser degree, or may be in nearly overlapping relationship. Also, in some embodiments one of the optical films 40A, 40B may extend beyond a respective lens 20A, 20B farther than the other of the optical films 40A, 40B and optionally, one of the optical films 40A, 40B may not extend beyond a respective lens 20A, 20B.

The end to end optical assembly configuration depicted and described herein may also enable one optical assembly to be lifted upwardly by a user and slid above and over another optical assembly to provide access to an interior of housing 5A or 5B for maintenance. For example, referring to FIG. 6A, a user may push upwardly on lens 20B, displacing it vertically relative to lens 20A, then push lens 20B toward lens 20A (toward the left looking at FIG. 6A), displacing it horizontally such that lens latitudinal end 21B is closer to lens latitudinal end 23A. The lens latitudinal end 21B may be displaced horizontally to a degree sufficient to access the interior of housing 5B.

Figure 6B:
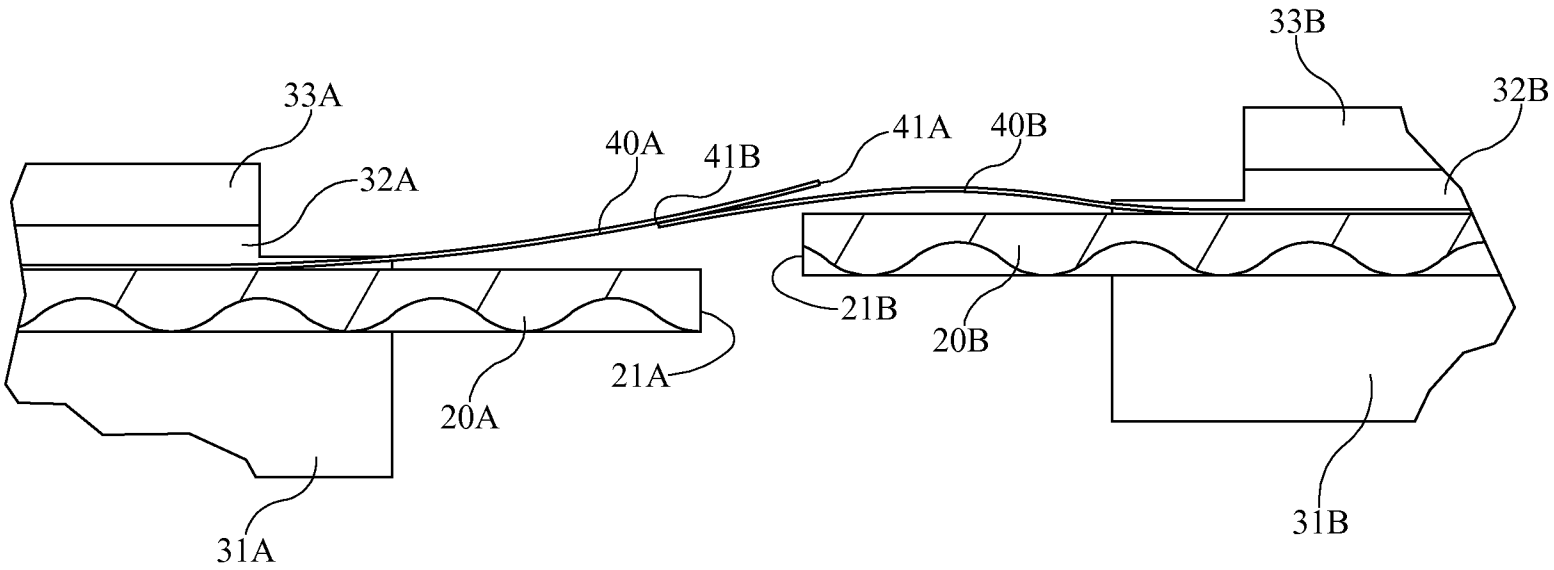
FIG. 6B shows a side section view of the optical assemblies of the first lighting fixture and the second lighting fixture of the embodiment of FIG. 1, when the lighting fixtures are coupled to one another in an end to end relationship, but the optical assemblies are vertically offset from one another.

Referring to FIG. 6B, a side section view of the optical assemblies of the first lighting fixture 10A and the second lighting fixture 10B are shown, when the lighting fixtures are coupled to one another in an end to end relationship, but the optical assemblies are vertically offset from one another. The optical assemblies may be vertically offset from one another due to, for example, improper installation, manufacturing variance, and/or a user installing or removing one of the optical assemblies. The latitudinal ends 21A, 21B of the lenses 20A, 20B are still adjacent each other, but are not touching one another. Also, the optical films 40A, 40B still overlap one another and each extends above a respective lens 20A, 20B. The optical films 40A, 40B are able to bend to non-planar positions while decreasing the likelihood of creasing/damaging the optical films 40A, 40B due to binding. The likelihood of binding the optical films 40A, 40B is decreased since the upper lips 33B, 38B on both ends of the supports 30B, 35B do not extend longitudinally as far as the optical films 40A, 40B and the lenses 20A, 20B.

Figure 7A:
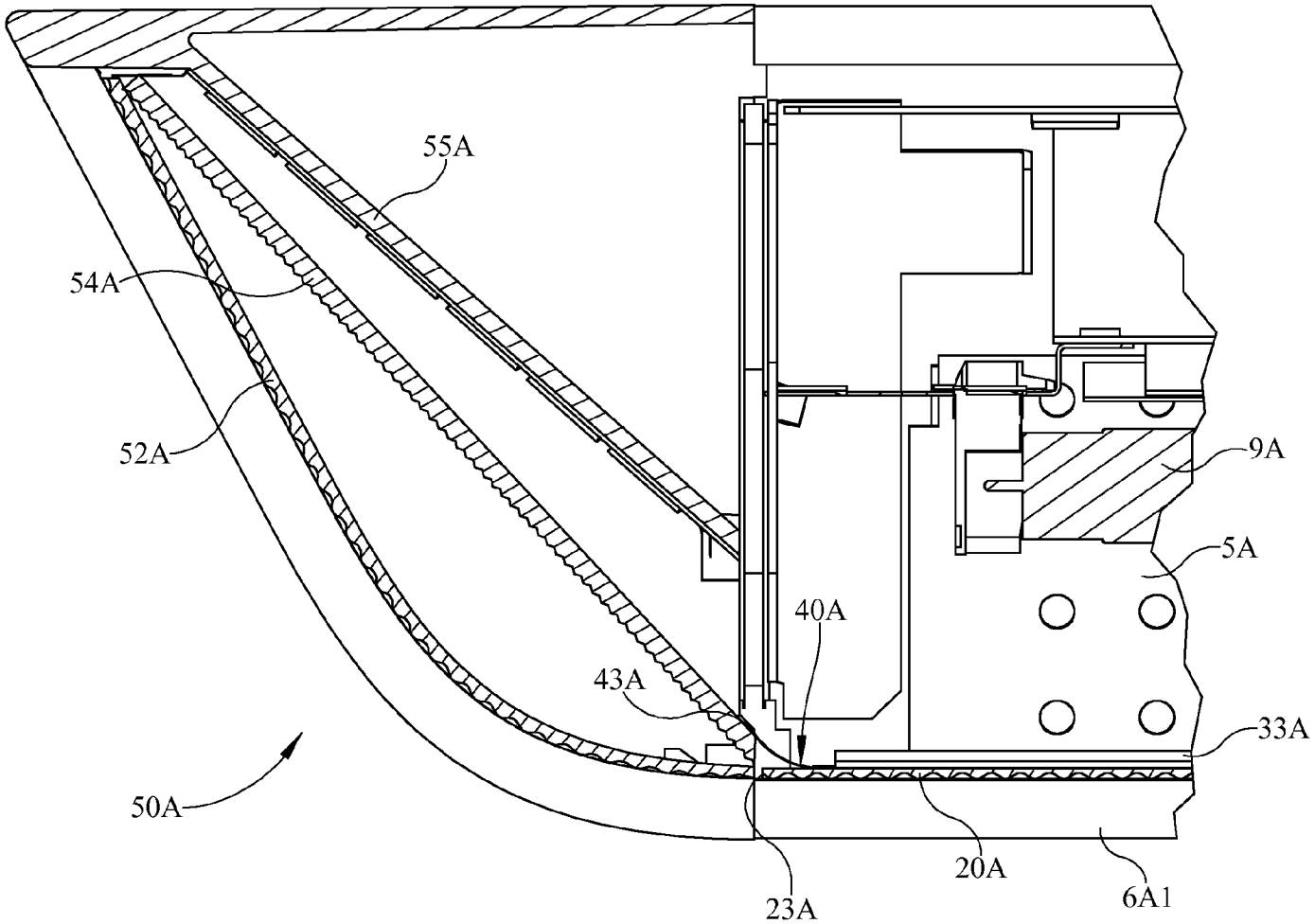
FIG. 7A shows a side section view of the first lighting fixture of the embodiment of FIG. 1 taken along the section line 7A-7A of FIG. 1.

Referring to FIG. 7A, a side section view of the first lighting fixture 10A taken along the section line 7A-7A of FIG. 1 is shown. The interaction between the optical assembly and the end cap 50A is shown in FIG. 7A. In some embodiments the end cap 50A may be omitted and the first lighting fixture 10A may be utilized as an intermediary fixture. The depicted end cap 50A includes the outer upwardly curved lens 52A, an interior substantially planar angled lens 54A, and an endcap housing member 55A. A reflector may optionally be coupled to, or adjacent to, the endcap housing member 55A generally facing the angled lens 54A. Light output from the light source 9A may enter the end cap 50A through the opening between the angled lens 54A and the endcap housing member 55A. Some of the light output may refracted through the angled lens 54A, and then through the outer lens 52A. Other light output may be internally reflected by the lens 54A, further reflected by the reflector optionally coupled to the endcap housing member 55A, and refracted through the angled lens 54A and the outer lens 52A. The refraction through and/or reflection by the angled lens 54A may help distribute light output over the entirety of the outer lens 52A.

The latitudinal end 43A of the optical film 40A extends atop the angled lens 54A and covers the gap present between the lens 20A and the end cap 50A. The optical film 40A is able to bend to a non-planar position and extend into end cap 50A while decreasing the likelihood of creasing/damaging the optical film 40A due to binding. The likelihood of binding the optical film 40A is decreased since the upper legs 32A, 37A and the upper lips 33A, 38A on the end of the supports 30A, 35A near the end cap 50A do not extend longitudinally as far as the optical film 40A and the lens 20A.

Figure 7B:
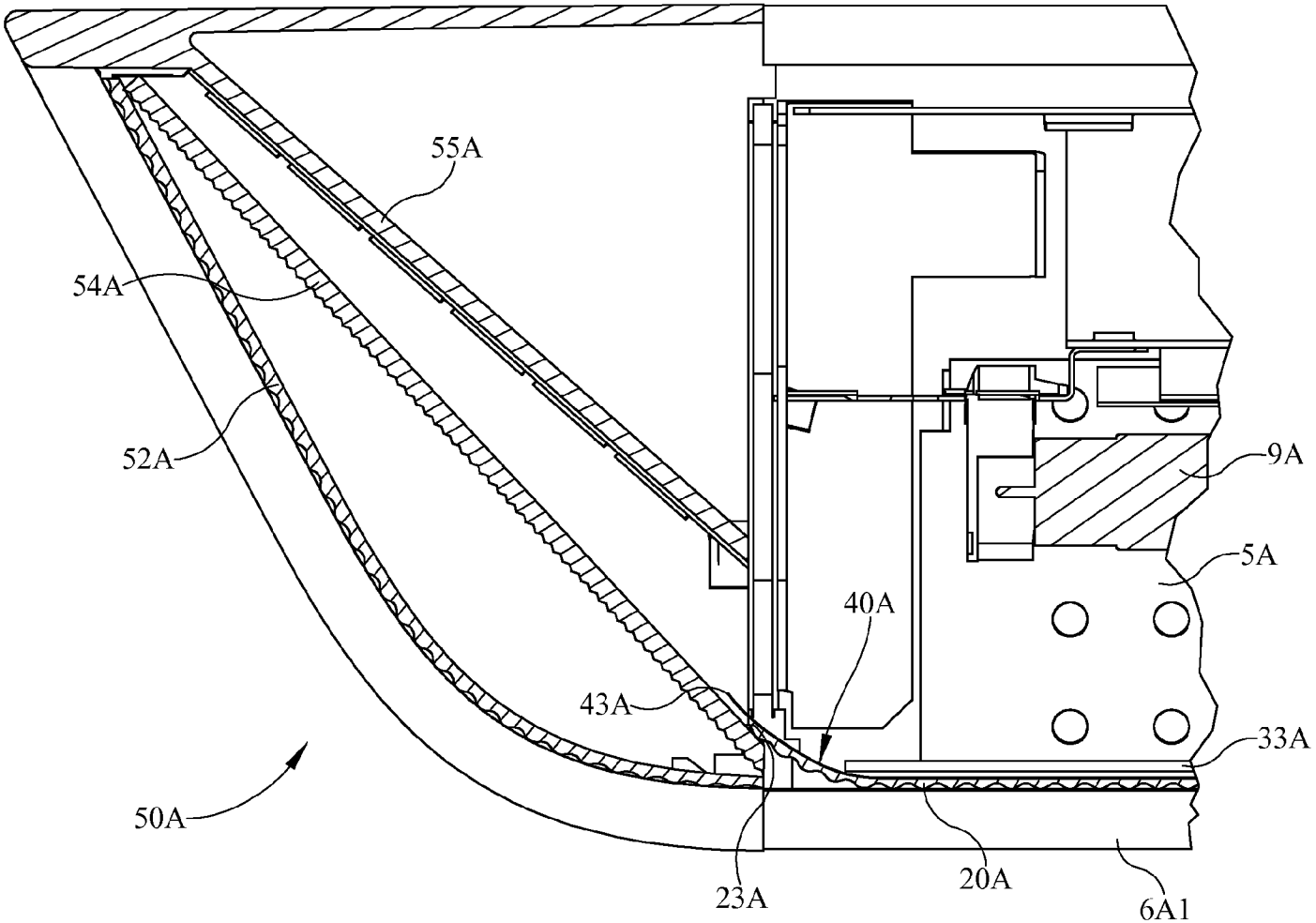
FIG. 7B shows a side section view of the first lighting fixture of the embodiment of FIG. 1 taken along the section line 7A-7A of FIG. 1, but with the lens of the optical assembly shown offset vertically and horizontally into the endcap.

FIG. 7B shows a side section view of the first lighting fixture 10A taken along the section line 7A-7A of FIG. 1, but with the lens 20A of the optical assembly shown offset vertically and horizontally into the endcap 50A. The lens 20A is able to flex upwardly at the latitudinal end 23A due to the lens extending beyond the supports 30A and 35A. The lens 20A may be offset vertically and horizontally into the endcap 50A by a user to help facilitate installation and/or removal of the optical assembly. For example, the lens 20A may be offset horizontally to enable a user to offset the lens 20A from an immediately adjacent lens, and thereby remove the lens 20A from the first latitudinal end 21A.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A lighting fixture, comprising:

a housing;

a longitudinally extending lens having a lens first latitudinal end, a lens second latitudinal end opposite said lens first latitudinal end, an interior face, and an exterior face opposite said interior face;

a longitudinally extending first support structure supported by said housing; said first support structure extending at least partially between said first latitudinal end and said second latitudinal end and supporting said lens; said first support structure including an upper lip structure on a first side of said lens extending above a portion of said lens;

wherein said interior face of said lens generally faces said first side;

an optical film atop said interior face of said lens, said optical film having an optical film first latitudinal end near said lens first latitudinal end and an optical film second latitudinal end near said lens second latitudinal end, said optical film extending between at least a portion of said upper lip structure and said lens; and a deformable structure compressed between said upper lip structure and said optical film;

wherein said deformable structure exerts force on said optical film, thereby compressing said optical film against said lens.

2. The lighting fixture of claim 1, further comprising a longitudinally extending second support structure supported by said housing, said second support structure and said first support structure flanking said lens.

3. The lighting fixture of claim 2, wherein said second support structure includes a second upper lip structure on said first side of said lens extending above a portion of said lens.

4. The lighting fixture of claim 3, wherein said optical film extends between at least a portion of said second upper lip structure and said lens, and said optical film is compression free where it extends between said second upper lip structure and said lens.

5. The lighting fixture of claim 1, wherein said optical film first latitudinal end extends beyond said lens first latitudinal end.

6. The lighting fixture of claim 3, wherein said lens first latitudinal end extends beyond said first support structure.

7. The lighting fixture of claim 1, wherein said deformable structure is tubular.

8. The lighting fixture of claim 1, wherein said deformable structure is less than fifteen percent of a length of said lens, said length of said lens being between the extent of said first latitudinal end and the extent of said second latitudinal end.

9. The lighting fixture of claim 8, wherein said deformable structure is less than five percent of said length.

10. The lighting fixture of claim 1, wherein said lens and said first support structure are formed as a cohesive integral piece.

11. A lighting fixture, comprising:

a housing having at least one light exit opening;

a lens, said lens supported by said housing across a majority of said light exit opening when installed in said housing, said lens having an interior face generally facing interiorly of said housing and an exterior face generally facing away from said housing when installed in said housing;

a lip structure spaced apart from and extending above a portion of said interior face of said lens proximal a peripheral portion of said lens;

an optical film atop said interior face of said lens;

wherein the interface between said optical film and said lens is substantially adhesive free;

a deformable structure compressed between said upper lip structure and said optical film;

wherein said deformable structure exerts force on said optical film thereby compressing said optical film against said lens; and wherein the length of said deformable structure is substantially shorter than the length of said lens.

12. The lighting fixture of claim 11, wherein said lens and said lip structure are formed as a cohesive integral piece.

13. The lighting fixture of claim 11, wherein said deformable structure is tubular.

14. The lighting fixture of claim 11, wherein said deformable structure is elastomeric.

15. The lighting fixture of claim 11, wherein the interface between said optical film and said lens is completely adhesive free.

16. The lighting fixture of claim 15, wherein the length of said deformable structure is less than ten percent of the length of said lens.

17. The lighting fixture of claim 11, wherein said light exit opening includes an unbounded portion.

18. An optical assembly, comprising:

a lens having a generally planar first side, a second side generally opposite said first side, and a periphery therearound;

a lip structure coupled to said lens, said lip structure spaced apart from and extending above said first side of said lens;

an optical film atop said first side of said lens;

wherein the interface between said optical film and said lens is adhesive free;

a deformable structure compressed between said upper lip structure and said optical film;

wherein said deformable structure exerts force on said optical film, thereby compressing said optical film against said lens; and wherein the length of said deformable structure is less than fifteen percent of the length of said lens.

19. The optical assembly of claim 18, wherein the length of said deformable structure is less than five percent of the length of said lens.

20. The optical assembly of claim 18, wherein said Hp structure is provided on a first longitudinal side of said lens and extends less than the length of said first longitudinal side of said lens.

* * * * *